United States Patent [19]

Suda et al.

[11] 3,955,812

[45] May 11, 1976

[54] FLAT-ARTICLE SEPARATING APPARATUS FOR AN AUTOMATIC MAIL HANDLING SYSTEM AND THE LIKE

[75] Inventors: Kazuyoshi Suda; Tomoyuki Isono; Seiichi Uematsu, all of Tokyo, Japan

[73] Assignee: Nippon Electric Company Limited, Tokyo, Japan

[22] Filed: Feb. 15, 1973

[21] Appl. No.: 332,843

[30] Foreign Application Priority Data

Feb. 17, 1972 Japan ..... 47-16623

[52] U.S. Cl. ..... 271/64; 271/182; 271/265

[51] Int. Cl.² ..... B65H 29/60

[58] Field of Search ..... 271/46, 57, 64, 172, 271/182, 265

[56] References Cited

UNITED STATES PATENTS

| | | | |
|---|---|---|---|
| 2,988,355 | 6/1961 | Rabinow et al. | 271/57 X |
| 3,276,771 | 10/1966 | Bruce et al. | 271/64 X |
| 3,283,163 | 11/1966 | Folmar | 271/57 X |
| 3,514,100 | 5/1970 | White | 271/64 MA |
| 3,724,657 | 4/1973 | Katagiri et al. | 271/64 X |

*Primary Examiner*—Evon C. Blunk
*Assistant Examiner*—Bruce H. Stoner, Jr.
*Attorney, Agent, or Firm*—Sughrue, Rothwell, Mion, Zinn and Macpeak

[57] ABSTRACT

A flat article separating apparatus for separating overlapping articles traveling along a feeding belt is disclosed. The apparatus includes a slipping section for causing overlapping articles to slip with respect to each other. Thereafter, the articles pass through a detector which detects the presence of an article and in response to such a detection, activates a moving roller aligned with a branching section of the feeding belt to cause the belt in the area of the branching section to bend. Bending of the feeding belt in the vicinity of the branching section allows the article in the branching section to be directed to a branch path of the feeding belt. Articles whose leading edges have passed the branching section at the time the moving roller is activated, continue to move along the main path of the feeding belt.

9 Claims, 35 Drawing Figures

FIG. 1
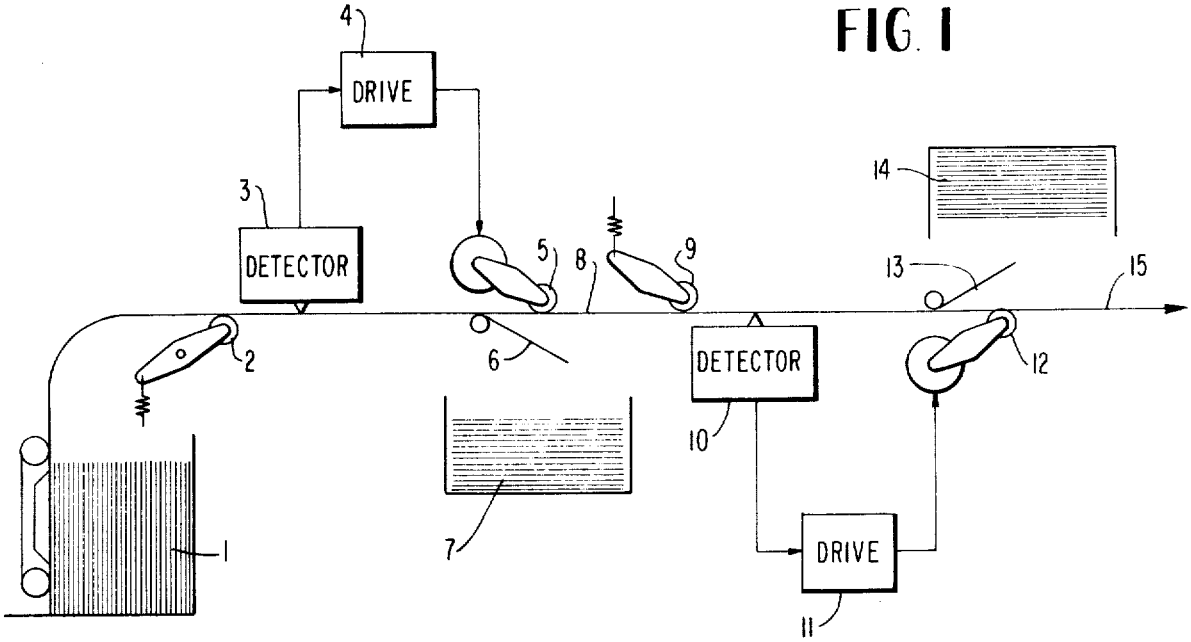
FIG. 2a
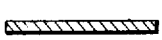
FIG. 2b
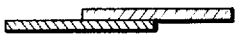
FIG. 2c
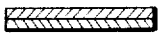
FIG. 2d
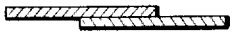
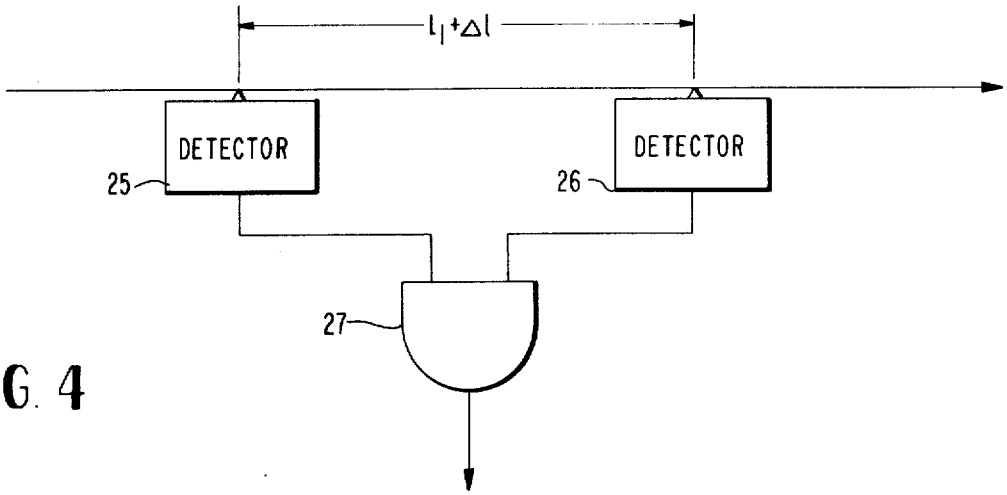
FIG. 4

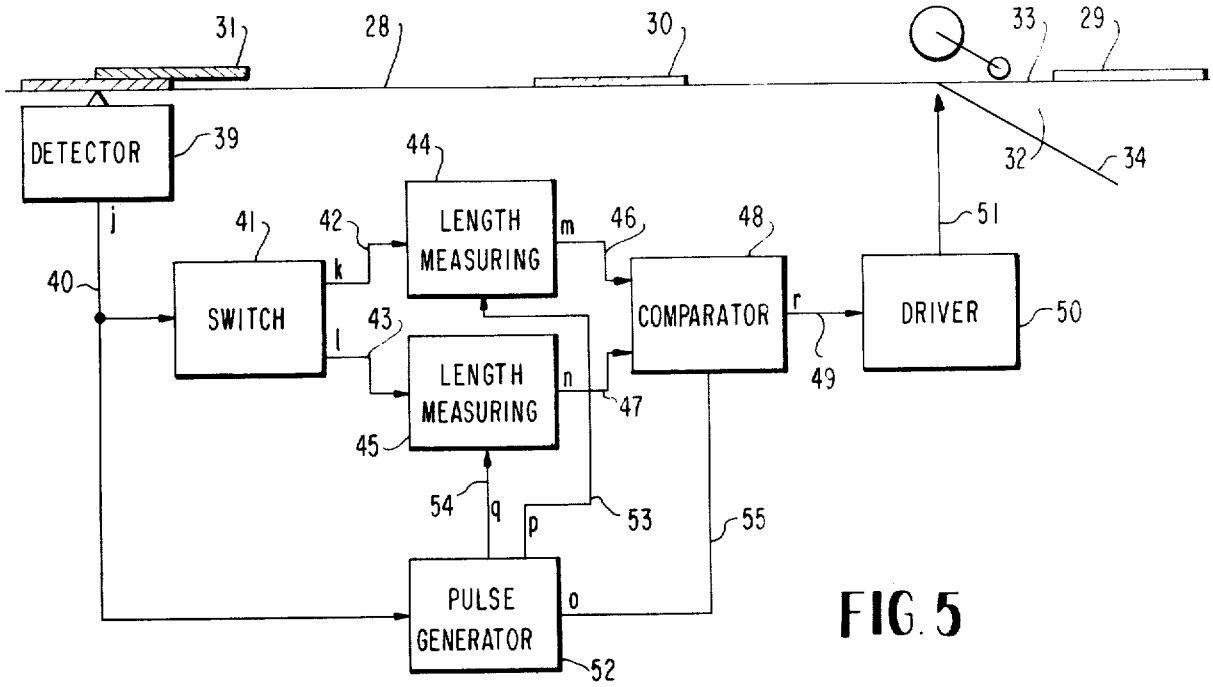
FIG. 5
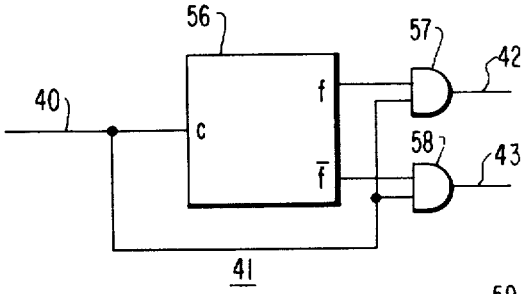
FIG. 6
FIG. 7
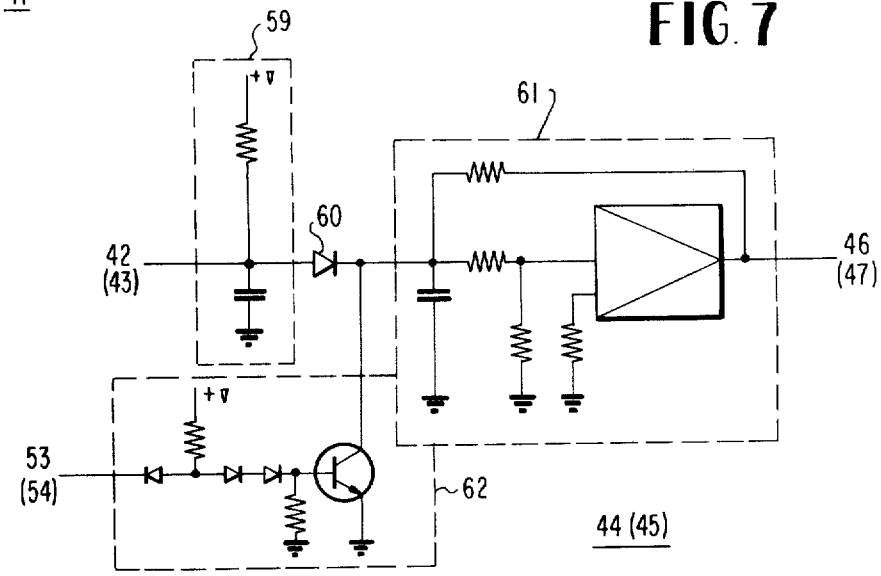

t1
t2
t3
1
0 v1
v3 v2

T1
T2
T3

FIG. 9
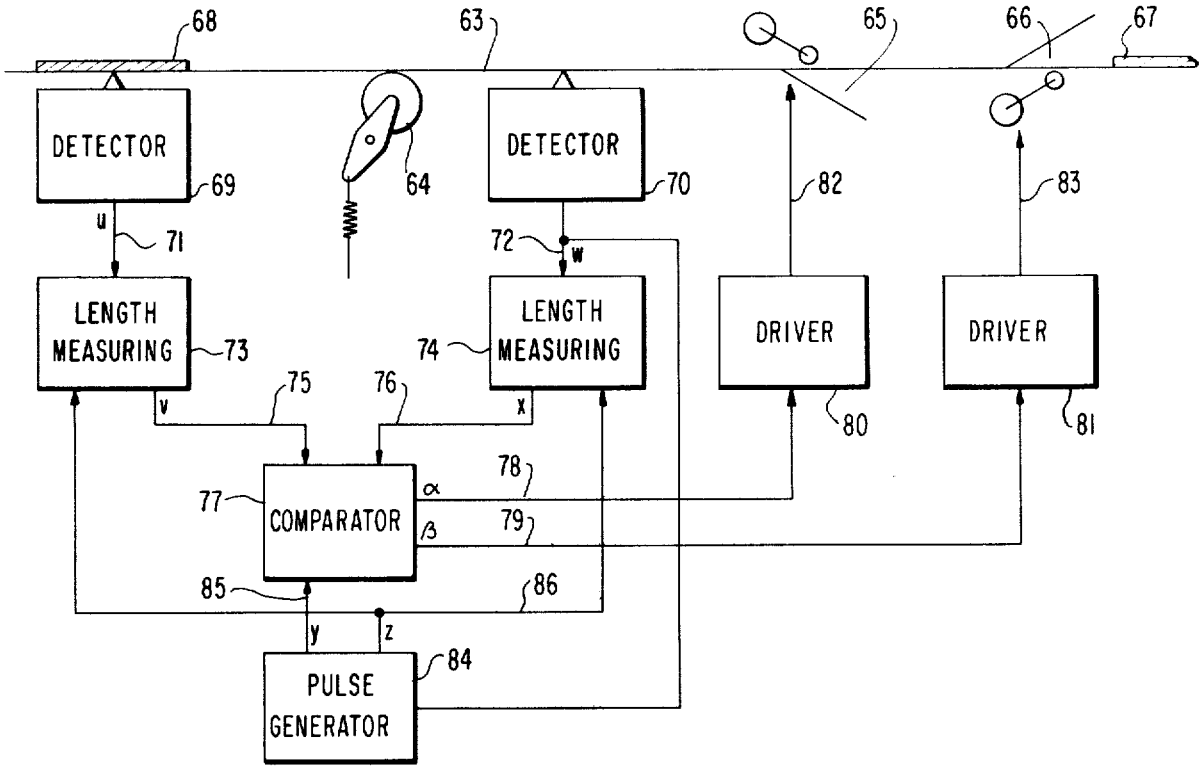
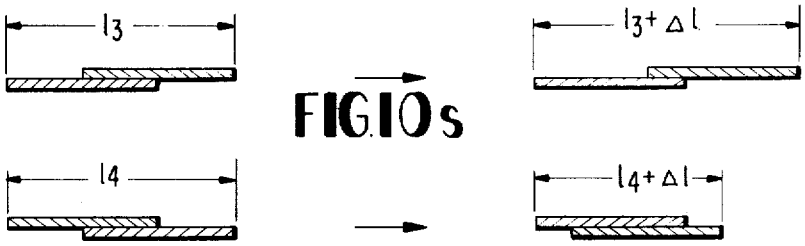
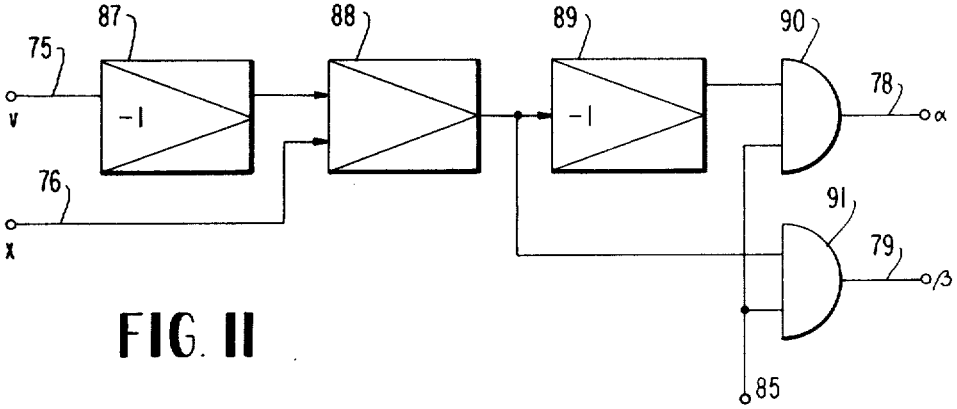
FIG. 11

FLAT-ARTICLE SEPARATING APPARATUS FOR AN AUTOMATIC MAIL HANDLING SYSTEM AND THE LIKE

BACKGROUND OF THE INVENTION

1. Field of the Invention

This invention relates to an automatic flat-article separating apparatus for use in an automatic mail-handling system and the like.

2. Description of the Prior Art

An automatic feeding apparatus for flat articles such as cards, envelopes and postcards, is designed, as shown in the U.S. Pat. No. 2,952,457, to feed the flat articles one by one. In such an apparatus, a plurality of flat articles are often transported as they are overlapped with each other. Such overlap-feeding causes errors in the automatic mail handling system. To guarantee accurate mail handling, the overlapped flat articles must be separated from each other.

For this purpose, various kinds of flat-article separating apparatuses have been proposed. However, those conventional apparatuses have a complicated mechanism and require a large space for installation, despite their relatively low reliability.

SUMMARY OF THE INVENTION

It is, therefore, an object of this invention to provide an improved automatic flat-article separating apparatus with a simplified mechanism.

According to this invention, there is provided an automatic flat-article separating apparatus for a mail-handling system and the like, in which the flat articles transported along feeding belts are caused to pass through a slipping section capable of creating, for a subsequent detection of the overlapped state, a slip between the articles when they are overlapped, and then fed to a branching section having a moving roller installed outside of the feeding belts so as to be responsive to the detection. More specifically, when the overlapped state is detected subsequently to the slipping process, the moving roller is actuated to press the feeding belts to form a bent portion at the belts of the branching section, thereby to separate the overlapped articles from each other.

BRIEF DESCRIPTION OF THE DRAWINGS

The features and advantages of this invention will be understood from the following detailed description of a preferred embodiment of this invention taken in conjunction with the accompanying drawings, wherein:

FIG. 1 is a schematic view of a first embodiment of this invention;

FIGS. 2(*a*) to 2(*d*) show four different modes of the overlapping of the flat article fed from feeding means;

FIGS. 3(*f*) to 3(*i*) show plan views illustrating how the branching is accomplished;

FIG. 4 is a schematic diagram of an overlap detector employed in the present apparatus;

FIG. 5 is a schematic diagram of a second embodiment of this invention;

FIG. 6 is a block diagram of a switching circuit for the second embodiment;

FIG. 7 is a circuit diagram of a length detecting circuit for the second embodiment;

FIG. 9 is a block diagram of a third embodiment of this invention;

FIGS. 10(*s*) and 10(*t*) show the changes of the total lengths of the overlapped flat articles caused by the slipping section;

FIG. 11 is a block diagram of a comparator for the third embodiment; and

DESCRIPTION OF THE PREFERRED EMBODIMENTS

Figure 3E:
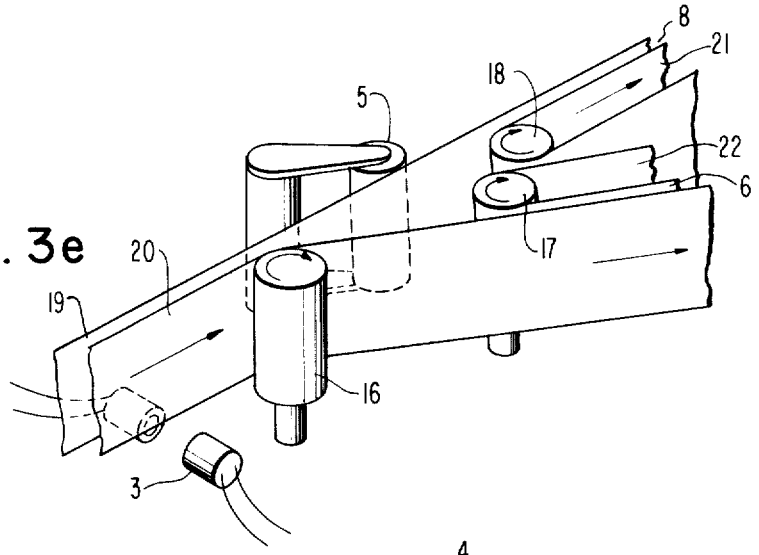
FIG. 3(*e*) is a perspective view of the separating section of the flat article transport path.
Figure 3F:
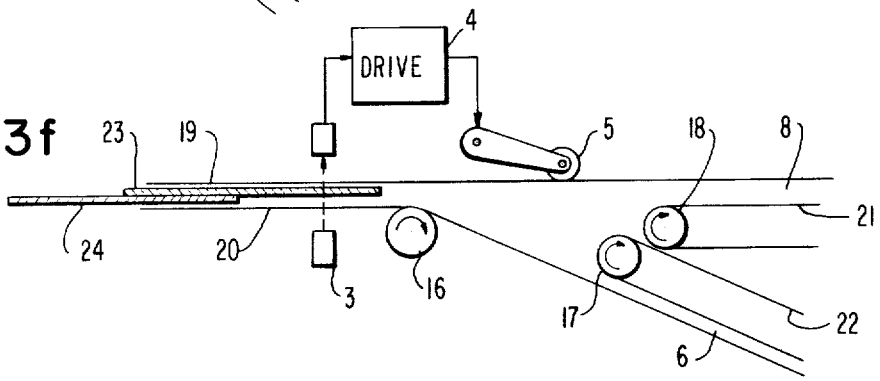
Figure 3G:
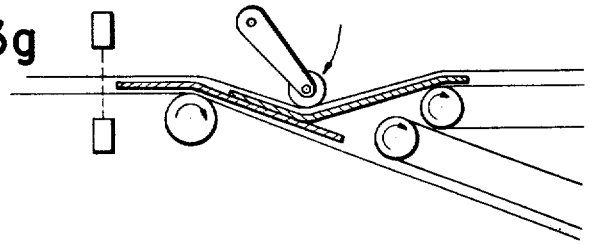
Figure 3H:
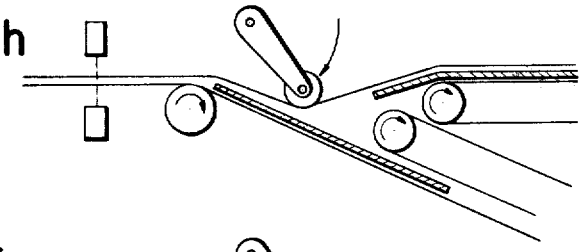
Figure 3I:
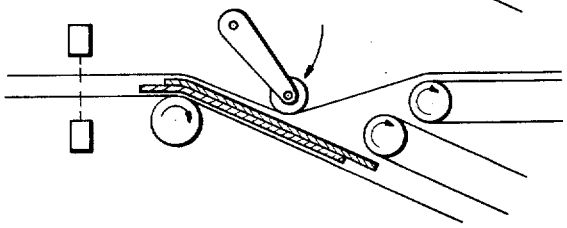

Referring to FIG. 1, a first embodiment of this invention comprises a feeder 1 designed, as shown in the above-mentioned U.S. Pat. No. 2,952,457, to feed the flat articles one by one. Under the normal state, the flat articles are fed from the feeder 1 without any overlapping as shown in FIG. 2(*a*). However, they are often overlapped while being fed, as shown in FIGS. 2(*b*), 2(*c*) and 2(*d*). It is a matter of course that the normal state shown in FIG. 2(*a*) appears at the highest probability, while other overlapped states shown in FIGS. 2(*b*), 2(*c*) and 2(*d*) appear at decreasing rates in that order, i.e., with the state shown in FIG. 2(*b*) appearing at a higher rate than shown in FIG. 2(*c*) higher than shown in FIG. 2(*d*).

The flat articles are then fed to a first slipping section having a slipping roller 2 disposed along a flat article transport path 15. The slipping roller 2 is installed at one side of the transport path 15 (in the drawing, under the transport path 15) to come in contact with the travelling flat articles. The roller 2 has a coefficient of friction greater than that of the flat article and is kept rotating at a speed lower, for example, than the travelling flat articles along the transport path 15. As a result, those underlying flat articles as viewed in FIGS. 2(*b*), 2(*c*) and 2(*d*) are respectively slipped leftward (i.e. backward). This slipping gives a greater displacement to the overlapped articles under shown in FIG. 2(*b*), to bring them to a state where they are separated from each other. Likewise, those under the states shown in FIG. 2(*d*) are brought to the states shown in FIGS. 2(*c*) and 2(*b*). The slipping roller 2 may be substituted by any other means such as a belt, a stationary plate having a coefficient of friction greater than the flat article, or a suction means.

The flat article passing through the first slipping section is fed to a first article-separating section comprising a detector 3, a timing/driving circuit 4, a moving roller 5, a main transport path portion 8 and a branching path 6. The first article separating section is shown in detail in FIGS. 3(*e*) through 3(*i*).

The main portion 8 comprises a roller 18 and conveyor belts 19 and 21, while the branching path 6 comprises rollers 16 and 17 and conveyor belts 20 and 22. The detector 3 is composed of a light source and a photoelectric device. The detector 3 detects the front edge of the flat article. The moving roller 5 is installed outside of the belt 19 in the middle of the branching path 6. The moving roller 5 is driven by the detected signal through the timing/driving circuit 4 to press the belt 19 as shown in FIG. 3(*g*). The timing/driving circuit 4 is adjusted so that the moving roller 5 operates when the detected front edge of the flat article comes into the main transport path portion 8 (FIG. 1) composed of the belts 19 and 21.

In the case where the overlapped flat articles 23 and 24 of the overlapped condition shown in FIG. 2(*b*) are fed to the first separating section as shown in FIG. 3(*f*), the front edge of the preceding article 23 is detected by the detector 3. When the front edge of the article 23 comes into the main path portion 8, the moving roller is driven to compress the belts 8 by the detected signal through the timing/driving circuit 4, as shown in FIG. 3(*g*). As a result, as shown in FIG. 3(*h*), the preceding article 23 is transported along the main path portion 8 and the following article 24 is fed through the branching path 6 to a stacker 7 (FIG. 1). After a predetermined period of time long enough to complete the separation, the moving roller 5 is reset to the normal state as shown in FIG. 3(*f*). Thus, the separation of the overlapped flat articles under the state shown in FIG. 2(*b*) is completed.

The non-overlapped flat article of the state shown in FIG. 2(*a*) is fed through the main path portion 8. Further, the overlapped flat articles under the states shown in FIGS. 2(*c*) and 2(*d*) are also fed through the main path portion 8 without being separated from each other.

The timing adjustment of the timing/driving circuit is achieved by a mechanical or an electrical means. The former is such that the distance between the detector 3 and the moving roller 5 is adjusted depending on the article transportation speed and the operating delay time of the moving roller 5 due to the operating speed thereof, and the latter is such that the signal detected by the detector 3 is delayed in accordance with the distance, the article transportation speed and the operating delay time of the moving roller 5.

The separating section for the overlapped flat articles may be used as an article branching section for switching the transport path of the flat article by adjusting the timing of the circuit 4 so that the moving roller 5 causes the compression of the belts when the edge of the flat article reaches near the moving roller 5, as shown in FIG. 3(*i*).

The flat article having passed through the first article-separating section is fed to a second slipping section having a slipping roller 9. The second slipping section is identical in construction to the first slipping section and installed at the side opposite thereto with respect to the transport path 15. The overlying flat articles (when viewed in the drawing) under the states shown in FIGS. 2(*c*) and 2(*d*) are slipped by the slipping roller 9 to be brought to the state shown in FIG. 2(*d*). The flat articles fed from the second slipping section under state shown in FIG. 2(*d*) are fed to a second separating section comprising a detector 10, a timing/driving circuit 11, a moving roller 12 and a branching path 13. The second separating section is identical in construction to the first one and installed at the side opposite to the first separating section with respect to the transport path 15. As a result, the leading one of the overlapped flat articles under the state shown in FIG. 2(*d*) is fed along the main transport path 15 while the trailing one is brought through the branching path 13 to a stacker 14.

In the first embodiment, the overlapped flat articles fed from the feeder 1 are passed through the first slipping section, whereby most of the overlapped flat articles are brought to the state shown in FIG. 2(*b*). The trailing one of the overlapped flat articles under the state shown in FIG. 2(*b*) is separated and fed to the stacker 7 through the first separating section. The flat articles under the states shown in FIGS. 2(*c*) and 2(*d*) which failed to be separated by the first separating section are passed through the second slipping section to arrive at the condition shown in FIG. 3(*d*). The trailing one of the articles under the state shown in FIGS. 2(*d*) is separated and fed to the stacker 14. Thus, the separation of the overlapped flat articles is completed to feed that article one by one along the main transport path 15.

In the first embodiment, however, the moving rollers operate every time the passing flat article is detected regardless of whether the flat articles are in the overlapped state. This imposes an excessive load on the operation of the moving rollers, adversely affecting the life of the apparatus.

In order to avoid this problem, only the overlapped flat articles should be detected. If all the flat articles fed from the feeder have a uniform length $l_1$, a length $l_2$ of the overlapped flat articles is always greater than $l_1$, namely $l_1 < l_2$ except for the state shown in FIG. 2(*c*). Therefore, it is possible to detect the overlapping of the flat articles by monitoring the length thereof with reference to $l_1$.

An overlap-detector for the flat article having the same length $l_1$ is shown in FIG. 4. The overlap-detector may be employed instead of the detectors 3 and 10. The overlap-detector comprises detectors 25 and 26 installed far apart from each other by a distance of $l_1 + \Delta l$ ($\Delta l > 0$), and an AND gate 27. The detectors 25 and 26 are identical in construction to the detector 3. The non-overlapped flat article having the length $l_1$ is not detected by both the detectors 25 and 26 simultaneously. Therefore, the output signal is not obtained at the AND gate 27. The overlapped flat-articles having a length greater than $l_1 + \Delta l$ are detected by both detectors 25 and 26 simultaneously for a period of time defined by the overlapped length. As a result, the output signal of the AND gate 27 is obtained. It is possible to operate the moving rollers 5 and 12 only when the overlapped flat articles are detected, with the output signal of the AND gate 27 applied to the corresponding timing/driving circuit 4 and 11, respectively. The detector shown in FIG. 4 can detect the overlapped flat articles under the state shown in FIG. 2(*c*) because the flat articles shown in FIG. 2(*c*) are slipped by the slipping section to the condition shown in FIGS. 2(*b*) or 2(*d*), all the overlapped flat articles are ultimately detected.

It is obvious to those skilled in the art that only one detector is sufficient to achieve the same objective when such a mono-stable multivibrator is employed as is capable of generating a pulse of the repetition period of $l_1 + \Delta l$ in response to the detected signal and comparing the periods of the generated pulse and the detected signal.

Referring to FIG. 5, there is shown a second embodiment of this invention adapted to the Batch Feed System in which the flat articles are classified into a plurality of groups, the articles in each group having a uniform length and being fed from the feeder in groups of the flat articles.

Figures 8J, 8K, 8L, 8M, 8N, 8O, 8P, 8Q, 8R:
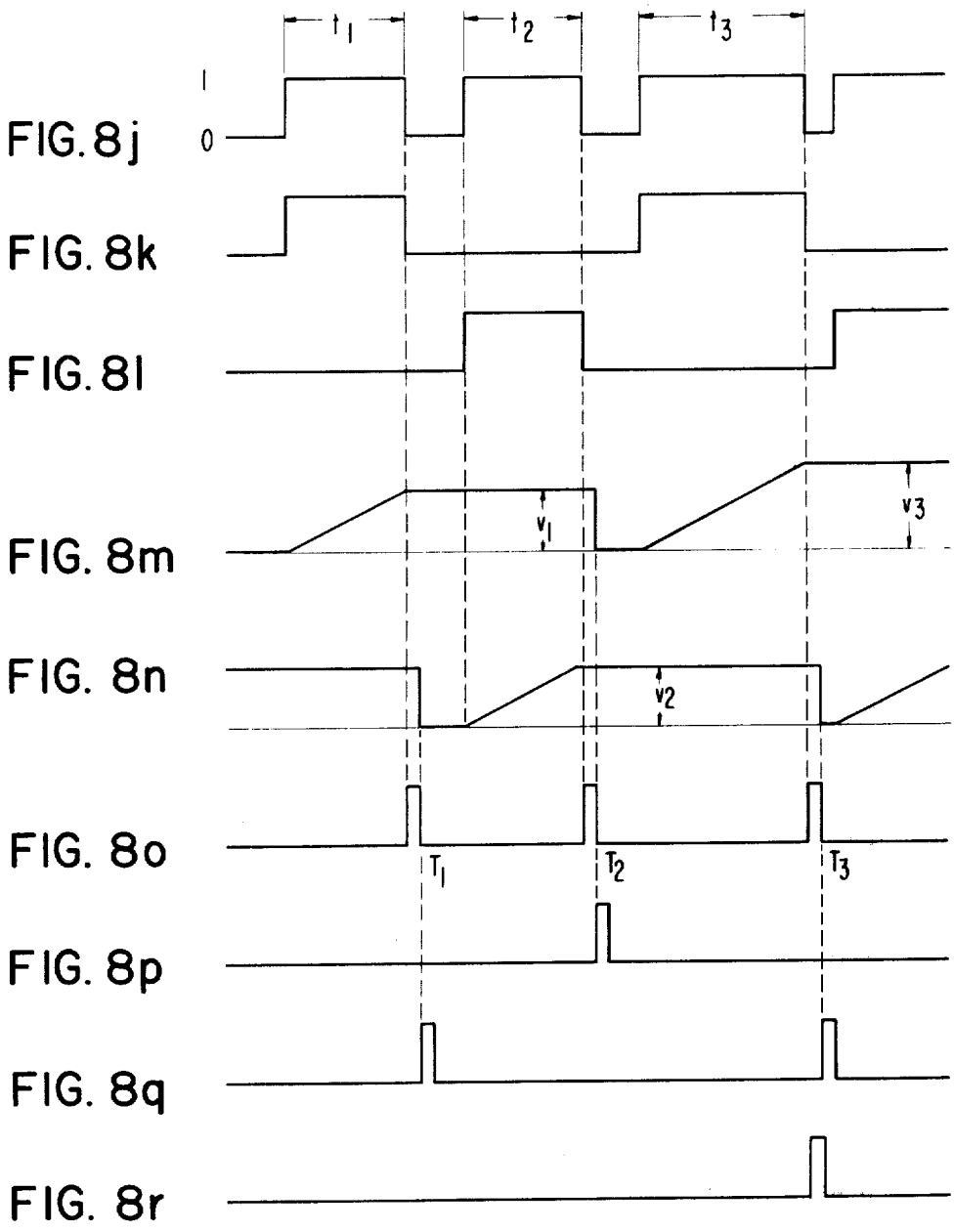
FIGS. 8(*j*) to 8(*r*) are wave form diagrams of signals appearing at various parts of the second embodiment.

Flat articles 29, 30 and 31 are fed along an article transport path 28 at a predetermined interval. The flat articles are first passed through a detector 39 identical in construction to the detector 3 (FIG. 1) for generating a detected signal (*j*) shown in FIG. 8(*j*) in response to a passage of the articles. The periods $t_1$, $t_2$ and $t_3$ correspond to the lengths of the articles 29, 30 and 31, respectively. The signal (j) from the detector 39 is supplied through a line 40 to a switching circuit 41 shown in FIG. 6 composed of a binary counter 56 and AND gates 57 and 58, and is alternately switched to alternately obtain two signals (*k*) and (*l*) shown in FIGS. 8(*k*) and 8(*l*) at two output terminals. The signal (j) is also supplied to a pulse generator 52 to obtain a sampling pulse (*o*) and reset pulses (*p*) and (*q*) shown in FIGS. 8(*o*), 8(*p*) and 8(*q*).

The signals (*k*) and (*l*) are supplied through wirings 42 and 43 to length detector 44 and 45, respectively. Each of the length detectors 44 and 45 is composed of, as shown in FIG. 7, a charging circuit 59, a diode 60, a holding circuit 61 and a reset circuit 62 for the charging circuit 59. The signal (*k*) or (*l*) supplied through the line 42 or 43 is supplied to the charging circuit 59, whereby the length information represented by the period of the signal (*j*) is changed to that represented by a voltage. The period-voltage-converted signal is supplied through the diode 60 to the holding circuit 61, and held in the holding circuit until it is reset by supplying the reset pulse (*p*) or (*q*) to the reset circuit 62. Thus, signals (*m*) and (*n*) shown in FIGS. 8(*m*) and 8(*n*) are obtained at the output of the length detectors 44 and 45, respectively. The diode 60 is installed between the charging circuit 59 and the holding circuit 61 so as to prevent the discharge of the voltage held in the holding circuit 61 when the signal (*k*) or (*l*) has disappeared.

The signals (*m*) and (*n*) held in the holding circuits whose voltages represent the length of the flat articles, are supplied through wirings 46 and 47 to a comparator 48, and compared with each other. In other words, the voltage representing the length of one flat article is compared with that of the other flat article which has passed immediately before the one flat article. This comparison is achieved at every time point of the sampling pulse (*o*). An output signal (*r*) shown in FIG. 8(*r*) is obtained only in the case where the voltage of the signals (*m*) and (*n*) do not coincide with each other.

Now, the articles 29 and 30 are fed one by one, respectively, and the articles 31 are fed under the overlapped state. At the time point $T_2$, the voltage $v_2$ corresponding to the period $t_2$ representing the length of the article 30 is compared with the voltage $v_1$ to the period $t_1$ of the article 29. Because of the non-overlapped state satisfying the condition $v_2 = v_1$, the output signal (*r*) is not obtained. At the time point $T_3$, the voltage $v_3$ corresponding to the period $t_3$ of the overlapped articles 31 is compared with the voltage $v_2$. The output signal (*r*) is obtained, because the articles 31 are in the overlapped state, and the voltage $v_3$ is greater than $v_2$.

The output signal (*r*) is supplied through a wiring 49 to a timing/driving circuit 50 and drives the moving roller. As a result, the leading one of the overlapped flat articles 31 is fed through the main transport path 31, and the following article of the articles 31 is separated and fed through a branching path 34.

In the second embodiment, the signals representing the length of the adjacently travelling flat articles are compared with each other, and the moving roller is driven so as to separate the overlapped flat article only when the signals representing the length are not coincident with each other.

At the start, there is no signal to be held in the holding circuit, i.e. the signal to be compared with the length-signal corresponding to the first fed flat article. As a result, the moving roller is driven in response to the non-coincidence of the signals to be compared, even if the first fed article is in the non-overlapped state. Furthermore, the moving roller is also driven with respect to the flat article (even if non-overlapped state) to be passed immediately after the overlapped flat articles, or the first flat article in the same length group. However, these flat articles can never be removed from the main transport path if these articles are in non-overlapped state, because the moving roller is driven when the front edge of the flat article comes into the main transport path, as described above.

When the flat articles of various lengths are fed at random to the second embodiment, the moving roller is very frequently driven irrespective of whether the overlapped state is detected or not. Now, an apparatus to which the flat articles of various lengths are fed at random will be described in conjunction with FIGS. 9 to 12.

Referring to FIG. 9, there is shown a third embodiment of this invention, in which the length of the flat article fed from the feeder is detected and stored, then further detected after passing through the slipping section. Two moving rollers located opposite each other in the main transport path are selectively driven in response to the change in length of the flat article before and after the passing through the slipping section.

Figures 12U, 12V, 12W, 12X, 12Y, 12Z:
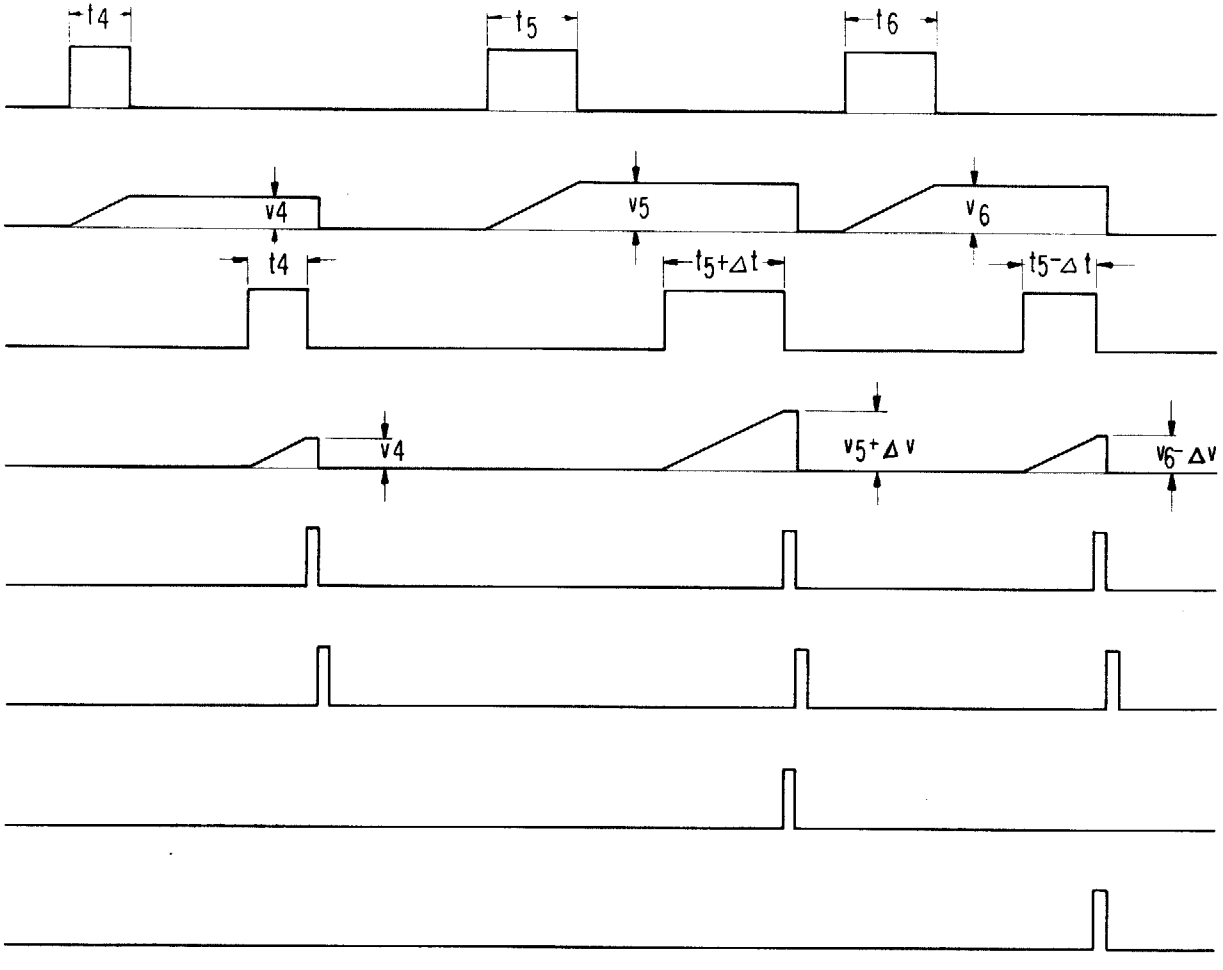
FIGS. 12(*a*) to 12(*B*) are wave form diagrams for signals appearing at various parts of the third embodiment.

The flat articles 67 and 68 fed from the feeder and transported along a main transport path 63 are first detected by a first detector 69 for generating a signal (*u*) shown in FIG. 12(u) and having pulse periods $t_4$, $t_5$ or $t_6$ corresponding to the length of the detected flat articles. The signal (*u*) is supplied through a wiring 71 to a first length-measuring circuit 73. At the first circuit 73, the signal (*u*) is converted to a first length signal having a voltage $v_4$, $v_5$ or $v_6$ corresponding to the article length which is stored whereby the stored first length signal (*v*) shown in FIG. 12(*v*) is obtained.

The flat articles detected by the first detector 69 are fed to a slipping section having a slipping roller 64 identical in construction to the slipping roller 2 (FIG. 1). The length of the overlapped flat articles is changed by the slipping roller 64 as shown in FIGS. 10(*s*) and 10(*t*), in response to the overlapped condition. The length $l_3$ of the overlapped flat articles shown in FIG. 10(s) is changed to $l_3 + \Delta l$, and the length $l_4$ of the flat articles shown in FIG. 10(t) to $l_4 - \Delta l$, where $\Delta l$ is a distance to be moved by the slipping roller 64. The length of the non-overlapped flat article is unchangeable.

The flat articles having passed through the slipping section is further detected by a second detector 70 for generating a signal (*w*) shown in FIG 12(*w*) having pulse repetition periods $t_4$, or $t_4 \pm \Delta t$ corresponding to the length of the flat articles after the slipping. The signal (*w*) is supplied through a wiring 72 to a second length-measuring circuit 74, and converted to a second length signal (*x*) shown in FIG. 12(*x*) having a voltage $v_4$ or $v_4 \pm \Delta v$ corresponding to the flat article. The signal (*w*) is supplied also to a pulse generator 84 to obtain a timing pulse (*y*) shown in FIG. 12(*y*), and a reset pulse (*z*) shown in FIG. 12(*z*) for resetting the first and the second length signals (*v*) and (*x*).

The first and the second length signals (*v*) and (*x*) are supplied through wirings 75 and 76 to a comparator 77, respectively. As shown in FIG. 11, the comparator 77 is composed of an amplifier 87 having a gain of −1, an operational amplifier 88, an amplifier 89 identical to the amplifier 87 and AND gates 90 and 91. The signal ($v$) is supplied to the amplifier 87 and polarity-inverted. The inverted signal is supplied to the operational amplifier 88 together with the signal ($x$). At the output of the amplifier 88, a difference signal is obtained representing the difference between the signals ($v$) and ($x$), namely, 0, $+\Delta v$ or $-\Delta v$. The difference signal is supplied to the AND gate 90 through the amplifier 89 and to the AND gate 91 directly. The timing pulse ($y$) from the pulse generator 84 is supplied to the AND gates 90 and 91. In the case where the flat articles are in the overlapped state shown in FIG. 10 ($s$), the signal ($\alpha$) shown in FIG. 12($\alpha$) is obtained at the output of the AND gate 78, while in the overlapped state shown in FIG. 10($k$), the signal ($\beta$) shown in FIG. 12($\beta$) is obtained at the output of the AND gate 91. In case of the non-overlapped state, no signal is obtained.

The signals ($\alpha$) and ($\beta$) are supplied through wirings 78 and 79 to the corresponding timing/driving circuits 80 and 81 to drive the moving rollers, respectively. Thus, the trailing one of the overlapped flat articles is separated and fed through the branching path 65 or 66.

What is claimed is:

1. A flat-article separating apparatus for separating overlapping flat articles travelling along a feeding route, said apparatus comprising:

a. a feeding route defined by first and second belts;

b. a main route defined by said first belt and a third belt, said main route being a substantial extension of said feeding route;

c. a branch defined by said second belt and a fourth belt, said feeding, main and branch routes being disposed on a common plane;

d. a branching section preceding said main and branch route in the direction of article travel and including at least one moving roller means for bending said first belt in said branching section; and e. detector means disposed adjacent said feeding route upstream of said branching section and responsive to the passage of an article therethrough for activating said roller means after the leading edge of the article is moved between said first and third belts to thereby divert any overlapped article into said branch route.

2. The separating apparatus of claim 1, further including article slipping means positioned along said feeding route at a location preceding said branching section in the direction of article travel for causing overlapping articles to slip relative to each other, said detector means being positioned to detect the presence of an article or overlapping articles after passing through said slipping means.

3. The separating apparatus of claim 1, wherein said articles are of equal length, said detecting means comprising first and second article detectors separated along the length of said feeding route by a distance greater than the length of said articles and coincidence gate means receiving the outputs of said first and second article detectors for producing a detection signal when said detectors simultaneously detect an article.

4. The separating apparatus of claim 2, further comprising:

a. an additional slipping means positioned along said main route for causing overlapping articles in said main route to slip relative to each other;

b. an additional branching section followed said main route, said additional branching section including an additional moving roller means for bending said third belt in said additional branching section;

c. an additional main route following said additional branching section and being a substantial extension of said first main route, said additional main route being defined by said third belt and a fifth belt;

d. a second branch route on the same plane as said feeding and main routes; and e. an additional detector means disposed adjacent said main route upstream of said additional branching section and responsive to the passage of an article therethrough for activating said additional moving roller means after the leading edge of the article is moved between said third belt and said fifth belt to thereby divert any overlapped article into said second branch route.

5. The separating apparatus of claim 4, wherein all articles conveyed along said feeding route are of equal length, each of said detecting means comprising first and second article detectors separated from each other by a distance greater than the length of said articles and coincidence gate means receiving the outputs of said first and second article detectors for producing detection signals when said detectors simultaneously detect an article.

6. The separating apparatus of claim 1, wherein said detector means comprises:

a. means for detecting the presence of an article;

b. switching circuit means for alternately producing first and second article presence signals, representing the detection of successive articles;

c. first and second article length measuring means responsive, respectively, to said first and second article presence signals and producing electrical signals proportional to the lengths of the articles indicated by said presence signals;

d. comparator means responsive to said first and second length measuring for producing an output signal when said article length proportional electrical signals are unequal; and e. driver/timer means responsive to said comparator output signal for activating said moving roller means.

7. The separating apparatus of claim 6, wherein said switching circuit means comprises:

a. input means responsive to said means for detecting the presence of an article;

b. a bistable circuit coupled to said input means and having first and second outputs; and c. first and second two input coincidence gates, one input of each of said gates being coupled, respectively, to the two outputs of said bistable circuit, the other inputs of said gates being coupled in common to said input means; and each of said article length measuring means comprising:

d. a charging circuit means responsive to said article presence signals for producing a signal proportional to the length of the detected article; and e. holding circuit means for storing said length propotional signals.

8. The separating apparatus of claim 1, wherein said detector means comprises:

a. first and second means for detecting the presence of an article;

b. first and second article length measuring means for producing electrical signals proportional to the lengths of the articles detected, respectively, by said first and second presence detecting means;

c. slipping means interposed between said first and second presence detecting means for causing overlapping articles to slip relative to each other;

d. comparator means responsive to said article length measuring means for producing output signals indicative of the difference between the length detected by said first length measuring means and said second length measuring means; and e. first and second driver/timer means responsive to said comparator output signals for selectively activating corresponding moving roller means.

9. The separating apparatus of claim 8, wherein said comparator means comprises:

a. first inverter means for inverting the length proportional electrical signal produced by said first length measuring means;

b. operational amplifier means for combining said inverted signal and the length proportional signal produced by said second length measuring means;

c. second inverter means responsive to said operational amplifier means;

d. first and second coincidence gates, ony input of said first gate being coupled to the output of said second inverted means, and one input of said second gate being coupled to the output of said operational amplifier means; and e. pulse generating means responsive to said second means for detecting the presence of an article, the second input of each of said gates being coupled in common to said pulse generating means.

* * * * *